US007164872B2

(12) United States Patent
Denpo

(10) Patent No.: US 7,164,872 B2
(45) Date of Patent: Jan. 16, 2007

(54) COPYING MACHINE AND A METHOD FOR SETTING THE NUMBER OF COPIES TO BE MADE

(75) Inventor: Toshiaki Denpo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 224 days.

(21) Appl. No.: 10/875,538

(22) Filed: Jun. 25, 2004

(65) Prior Publication Data

US 2004/0264994 A1 Dec. 30, 2004

(30) Foreign Application Priority Data

Jun. 30, 2003 (JP) ..... 2003-188192

(51) Int. Cl.
*G03G 15/00* (2006.01)

(52) U.S. Cl. ..... 399/81

(58) Field of Classification Search ..... 399/81, 399/75, 76, 77
See application file for complete search history.

(56) References Cited

U.S. PATENT DOCUMENTS 4,361,395 A * 11/1982 Washio et al. ..... 399/81
4,975,734 A * 12/1990 Mishima ..... 399/81 X
5,311,257 A * 5/1994 Ishii et al. ..... 399/81
5,969,826 A * 10/1999 Dash et al. ..... 399/81 X

FOREIGN PATENT DOCUMENTS

JP B2 56-24268 6/1981
JP B2 60-3182 1/1985

* cited by examiner

*Primary Examiner*—Sophia S. Chen
(74) *Attorney, Agent, or Firm*—Oliff & Berridge, PLC

(57) ABSTRACT

A copying machine includes a storing portion that stores a value with n (n≧2) digits, the n digits having a range from a first digit to an nth digit on a left side of the first digit, wherein the value indicates a number of copies to be made, a number input portion capable of inputting numbers, a copy start input portion capable of inputting an instruction to start copying a document, a copying portion that copies the document based on the value stored in the storing portion when the instruction to start copying is input and a controller that performs a set process and a resetting process.

24 Claims, 5 Drawing Sheets

COPYING MACHINE AND A METHOD FOR SETTING THE NUMBER OF COPIES TO BE MADE

CROSS-REFERENCE TO RELATED APPLICATION

This application claims priority from JP 2003-188192, filed Jun. 30, 2003, the disclosure of which is incorporated in its entirety herein by reference thereto.

BACKGROUND OF THE INVENTION

1. Field of Invention

The invention relates to a copying machine, a program for setting the number of copies to be made, and a method for setting the number of copies to be made available in the copying machine.

2. Description of Related Art

Conventionally, a typical copying machine is structured such that when a number of copies to be made is input by pressing a number button, a value for the number of copies is stored in the memory, and a document or a stack of documents placed in a specified place is copied in accordance with the value stored in the memory.

In this case, a number corresponding to a pressed button, which is stored in the memory by pressing the number button, is initially stored as a units digit. After that, every time a new number button is pressed, the number corresponding to the pressed button is recognized as the units digit, and the number previously stored in the memory is newly stored as a tens or higher digit. Thus, a plurality of numbers can be entered and placed at a particular digit location in order to set the value corresponding to the number of copies to be made. For example, if the copying machine is capable of storing a hundreds digit in the memory, a display of the copying initially shows "001" to indicate that one copy is selected. If the user presses the "2" button, "002" is stored in the memory. After that, when the user continuously presses "5" and "7" buttons, "257" is stored in the memory.

In this kind of copying machine, various proposals have been made to reduce the amount of problems associated with entering the number of copies by a user. For example, Japanese Patent Publication No. 56-024268 discloses a technique for setting the initial value for the number of copies to "1" in the memory after a switch (a reset switch) to reset the value for the number of copies is pressed. Thereby, when the value for the number of copies is "1" after the switch is pressed, the need to set the value for the number of copies again is eliminated.

Japanese Patent Publication No. 60-003182 discloses a technique for setting "1", the initial value, in the memory (a device for displaying the number of copies) where a value for the number of copies to be made is stored after a fixed time period passes after copying a document. Thereby, even if the user forgets to reset the previously set value for the number of copies, an accidental reproduction is prevented.

The copying machines described above are structured to be capable of performing operations not only for inputting the number of copies and starting to make copies, but also for allowing various settings regarding the functions of the copying machine (hereinafter, this is referred to as a setting operation).

The setting operation is performed before the number of copies is input and sometimes after the number of copies has been input. Especially, when the setting operation is performed after the number of copies has been input, the number of copies may be accidentally input again although it has been already input and the number of copies may need to be input again according to settings.

However, even in such a case, in the conventional copying machines as described above, the newly input number is regarded as the units digit and the numbers previously stored in the memory are shifted one position to the left as a tens or higher digit. The numbers are stored again as the value for the number of copies to be made. As such, the value that the user does not intend may be set as the number of copies to be made.

In this case, the number of copies, which is different from that the user intends, may be made. The user may also be requested to redo a useless input operation for the number of copies. The usability of the copying machine thus deteriorates.

SUMMARY OF THE INVENTION

The invention thus provides, among other things, a technique to improve a usability with regard to setting the value for the number of copies to be made in a copying machine.

According to one exemplary aspect of the invention, a copying machine includes a storing portion that stores a value with n ($n \geqq 2$) digits, the n digits having a range from a first digit to an nth digit on a left side of the first digit, wherein the value indicates a number of copies to be made; a number input portion capable of inputting numbers; a copy start input portion capable of inputting an instruction to start copying a document; a copying portion that copies the document based on the value stored in the storing portion when the instruction to start copying is input; and a controller. The controller performs a set process when a new number is input via the number input portion, wherein the value is set such that the new number is newly set as the first digit on a right side of the value and at least one previous number at an ith digit ($1 \leqq i$) of the value is newly set as a (i+1)th digit from the right side of the value and the value that has been set is stored in the storing portion; and performs a resetting process when the new number is input via the number input portion after an operation is performed other than by inputting the new number and up until a time when the instruction to start copying the document is input, wherein the value stored in the storing portion is deleted and the new number input via the number input portion is stored in the storing portion as the first digit of the value.

According to another exemplary aspect of the invention, a program sets a value indicating a number of copies to be made in a computer system, the computer system including a storing portion that stores the value with n ($n \geqq 2$) digits, the n digits having a range from a first digit to an nth digit on a left side of the first digit; a number input portion capable of inputting numbers; a copy start input portion capable of inputting an instruction to start copying a document; and a copying portion that copies the document based on the value stored in the storing portion when the instruction to start copying is input. The program includes a first routine that, when a new number is input via the number input portion, sets the value such that the new number is newly set as the first digit on a right side of the value and at least one previous number at an ith digit ($1 \leqq i$) of the value is newly set as a (i+1)th digit from the right side of the value and stores the value that has been set in the storing portion; and a second routine that, when the new number is input via the number input portion after an operation is performed other than by inputting the new number and up until a time when the instruction to start copying the document is input, deletes the value stored in the storing portion and stores the new number input via the number input portion in the storing portion as the first digit of the value.

The program that sets the value indicating the number of copies to be made is formed of a sequence of ordered instructions suitable for processing by the computer system, and is provided to the copying machine, the computer system, or a user of the copying machine and the computer system via a recording medium such as an FD, a CD-ROM, a memory card, or a communication line network such as the Internet. As a computer system that runs the program that sets the value indicating the number of copies, for example, a computer system built in a copying machine, a computer system connected to a copying machine via a wireless or wired transmission path to enable data communication with each other can be used.

According to another exemplary aspect of the invention, a method is included for setting a value indicating a number of copies to be made in a copying machine, the copying machine including a storing portion that stores the value with n ($n \geqq 2$) digits, the n digits having a range from a first digit to an nth digit on a left side of the first digit; a number input portion capable of inputting numbers; a copy start input portion capable of inputting an instruction to start copying a document; and a copying portion that copies the document based on the value stored in the storing portion when the instruction to start copying is input. The method includes the steps of setting the value, when a new number is input via the number input portion, such that the new number is newly set as the first digit on a right side of the value and at least one previous number at an ith digit ($1 \leqq i$) of the value is newly set as a (i+1)th digit from the right side of the value and storing the value that has been set in the storing portion and deleting the value stored in the storing portion and storing the new number input via the number input portion in the storing portion as the first digit of the value when the new number is input via the number input portion after an operation is performed other than by inputting the new number and up until a time when the instruction to start copying the document is input.

In the method for setting the value indicating the number of copies, when the new number is input via the number input portion, the new number is newly set as the first digit on the right side of the value and the at least one previous number at the ith digit ($1 \leqq i$) of the value is newly set as the (i+1)th digit from the right side of the value and the value that has been set is stored in the storing portion.

When the new number is input via the number input portion after an operation is performed other than by inputting the new number and up until a time when the instruction to start copying the document is input, the value stored in the storing portion is deleted and the new number input via the number input portion is stored in the storing portion as the first digit of the value.

According to another exemplary aspect of the invention, a method for setting a value indicating a number of copies to be made in a copying machine includes setting the value, when a new number is input, such that the new number is newly set as a first digit on a right side of the value and at least one previously input number at an ith digit ($1 \leqq i$) of the value is newly set as a (i+1)th digit from the right side of the value; and deleting the value and storing the new number input as the first digit of the value when the new number is input after an operation is performed other than by inputting the new number and up until a time when the instruction to start copying a document is input.

BRIEF DESCRIPTION OF THE DRAWINGS

An embodiment of the invention will be described in detail with reference to the following figures wherein.

DETAILED DESCRIPTION OF PREFERRED EMBODIMENTS

An embodiment of the invention will be described in detail with reference to the accompanying drawings.

Figure 1:
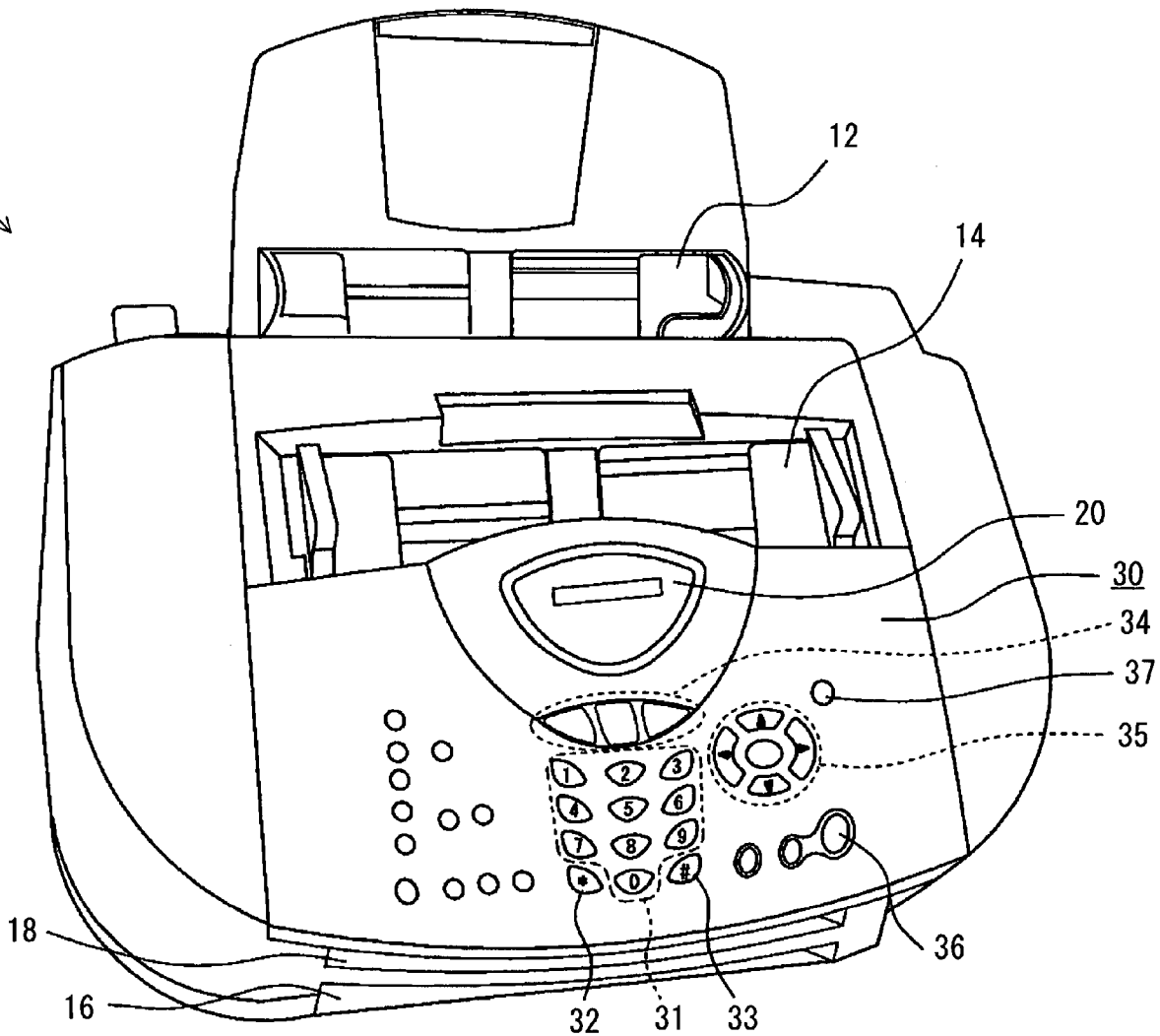
FIG. 1 is a perspective view showing a multifunction machine.
Figure 2:
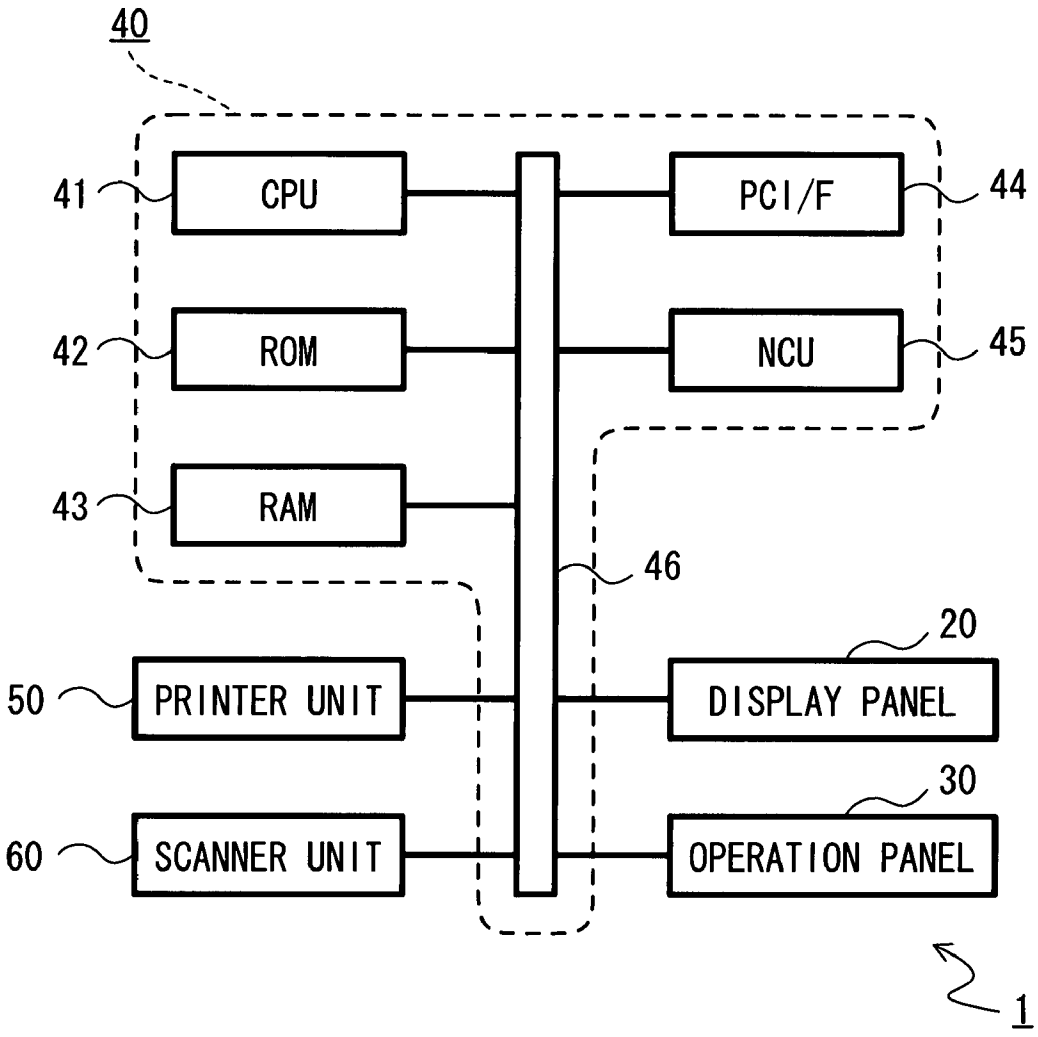
FIG. 2 is a block diagram showing a configuration of the multifunction machine.

As shown in FIG. 1, a multifunction machine 1 serves as a printer, a copier, a scanner, and a facsimile, and is provided with a print paper supply portion 12 disposed at the rear of the main body, a read paper supply portion 14 disposed at the rear of the upper part of the main body, a printed paper output portion 16 and a read paper output portion 18 disposed at the rear of the main body, a display panel 20 disposed in the center of the upper part of the main body, and an operation panel 30 disposed at the front of the main body. A control unit 40 that controls the entire operation of the multifunction machine 1, a printer unit 50, and a scanner unit 60 are built in the multifunction machine 1.

The operation panel 30 includes number buttons 31 from 0 to 9, an "*" button 32, a "#" button 33, function buttons 34 for switching available functions (to either one of a copier function, a scanner function, and a facsimile function), set buttons 35 for setting each function, a start button 36, and a power button 37.

The control unit 40 is structured of a CPU 41, a ROM 42, a RAM 43, a PC interface part (hereinafter referred to as PCI/F) 44, and a NCU (network control unit) 45, which are all connected via a bus 46.

Among these parts, the CPU 41 controls the entire operation of the multifunction machine 1 while sending commands to each structural element of the multifunction machine 1 via the bus 46 while storing process results in the RAM 43 based on a procedure (program) previously stored in the ROM 42. The PCI/F 44 is an interface for connecting the multifunction machine 1 to a known personal computer (PC) via a communication cable to enable data communications therebetween. The NCU 45 is an interface for connecting the multifunction machine 1 to a telephone line network.

The printer unit 50 is a structural element that prints images to a sheet of paper set in the print paper supply portion 12 in place while conveying it to the printed paper output portion 16. A printing method of the printer unit 50 may be an inkjet method, a laser method, or a heat transfer method. In other words, any printing method is available as long as it is capable of printing.

The scanner unit 60 is a structural element that reads an image printed on a document set in place in the paper supply portion 12 while conveying it to the read paper output portion 18.

The following is a description of a procedure (program) executed by the CPU 41 after the function is switched to a copy function at the press of the copy function button 34*a*

Figure 3:
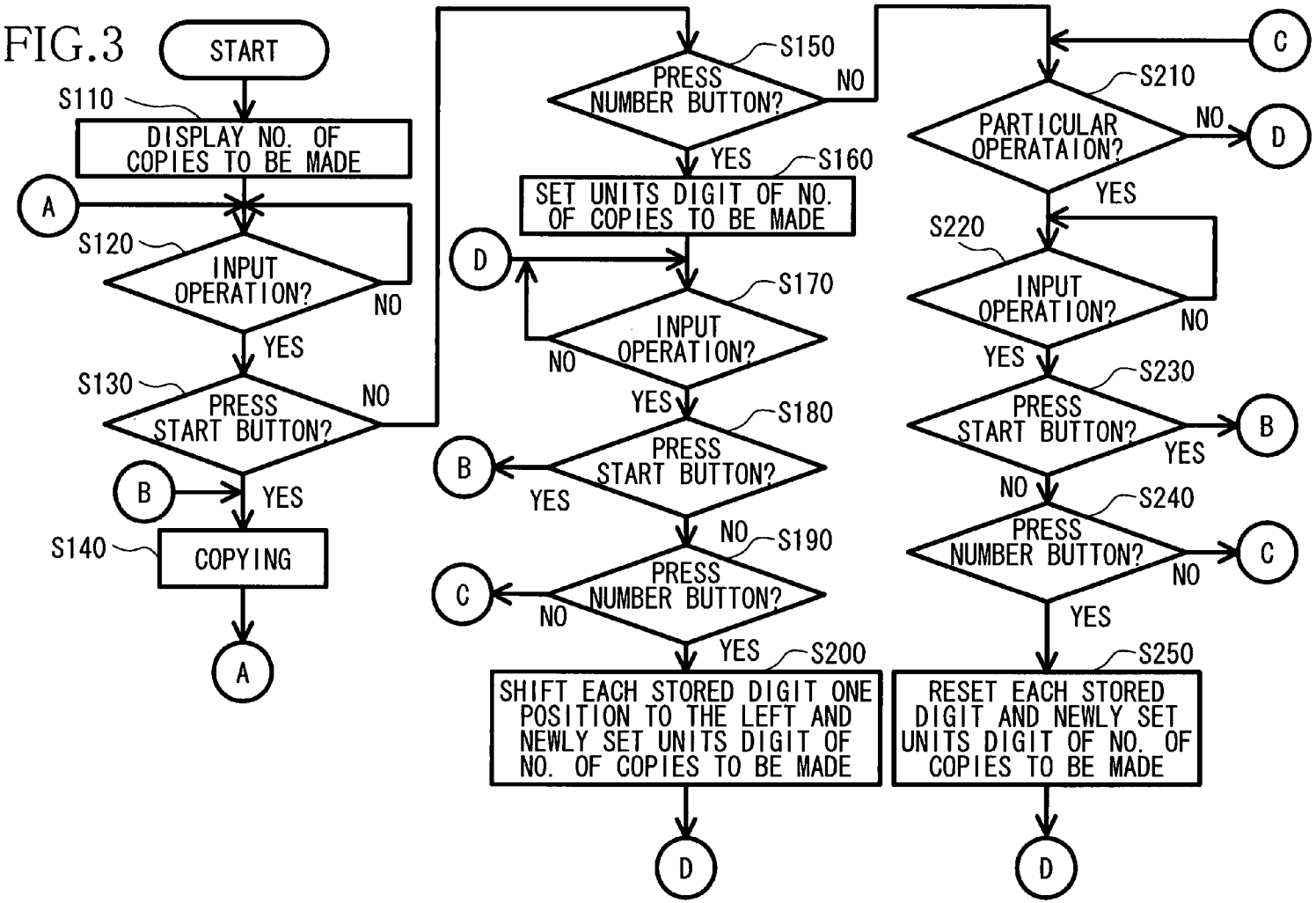
FIG. 3 is a flowchart showing a series of steps executed by a CPU of the multifunction machine.

(FIG. 4) of the function buttons 34, with reference to FIG. 3. This procedure is repeatedly executed until the function is switched to a scanner function or a facsimile function at the press of the scanner function button 34*b* or the facsimile function button 34*c*.

First, the number of copies to be made is displayed on the display panel 20 (S110: S represents a single step). In this step, the value of the number of copies indicated by a variable "n" stored in the RAM 43 is displayed on the display panel 20. The variable "n" is a set of values respectively assigned in a range from the first digit on the right representing the units digit to the xth digit from the right representing the tens or higher digit (x is an integer greater than or equal to 2; in this embodiment, x is 2, the first digit on the right is the units digit, and the xth digit is the tens digit). In an initial state, "1" is set in n[1] and "0" is set in n[2]. That is, in the initial state, the number of copies to be made is displayed as "01" on the display panel 20.

The CPU 41 waits until an input operation is made to the operation panel 30 by a user (S120: NO). If the user inputs an operation (S120: YES), it is determined whether the user pressed the start button 36 (S130).

If the user pressed the start button 36 (S130: YES), the multifunction machine 1 performs copying according to the value of the number of copies set (S140). In this step, the control unit 40 of the multifunction machine 1 directs the scanner unit 60 to read an image from a document set in the read paper supply portion 14 and the printer unit 50 to print the image read from the document onto a sheet of paper set in the print paper supply portion 12. The control unit 40 directs the printer unit 50 to print copies in accordance with the value of the number of copies indicated by the variable "n" stored in the RAM 43. In other words, if the value is 2, for example, the printer unit 50 prints 2 copies of the document. Thereby, the document set in the read paper supply portion 14 is copied (reproduced). After step S140 is completed, the flow returns to step S120.

On the other hand, in step S130, if the user did not press the start button 36 (S130: NO), it is determined whether the user pressed a number button 31 (S150).

If the user pressed a number button 31 (S150: YES), a number corresponding to the number button 31 pressed is set as the units digit for the value of the number of copies to be made (S160). In this step, the number corresponding to the number button 31 pressed is set in a variable n[1], so that the units digit for the value of the number of copies to be made is set.

Figure 4A:
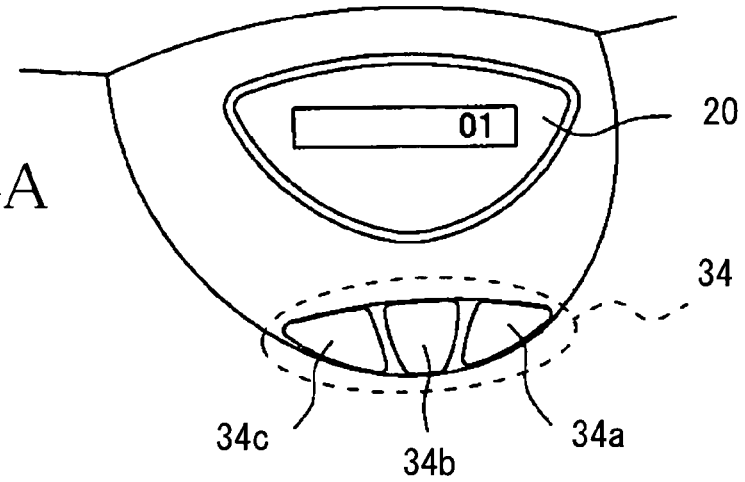
FIGS. 4A–4C show the number of copies to be made that is displayed on a display panel.

In addition, in step S160, what is displayed on the display panel 20 is also changed according to a value set in the variable n. When "1" among the number buttons 31 is pressed, "01" for the number of copies is displayed on the display panel 20, which is shown in FIG. 4A. Even when "1" is pressed, "01" for the number of copies is displayed on the display panel 20 even though "01" is set as an initial value in step S110. Although it seems that nothing has been done in step S160 at first glance, however, a units digit for the number of copies to be made is actually reset. In this case, if "2" of the number buttons 31 is pressed, "02" is displayed for the number of copies on the display panel 20, needless to say.

Then, the CPU 41 waits until an input operation is made to the operation panel 30 by the user (S170: NO). If the user inputs an operation (S170: YES), it is determined whether the user pressed the start button 36 (S180).

If the user presses the start button 36 (S180: YES), the flow goes to step S140. On the other hand, if the user did not press the start button 36 (S180: NO), it is determined whether the user in step S170 pressed a number button 31 (S190).

If the user in step S170 pressed a number button 31 (S190: YES), each number stored in the RAM 43 is shifted one digit position to the left, and the number corresponding to that of the number button 31 pressed is newly set as a units digit (S200). In this step, the variable n[i] ($1 \leqq i \leqq x$) is reset to the variable n[i+1], then the number corresponding to that of the number button 31 pressed is set to the variable n[1], so that the value for the number of copies to be made as indicated by the variable "n" is newly set in the RAM 43.

Figure 4B:
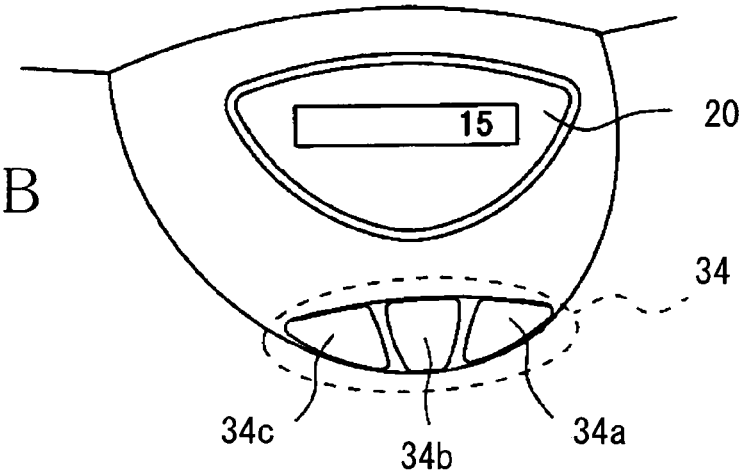

In addition, in step S200, as is the case with step S160, what is displayed on the display panel 20 is also changed according to the value set in the variable n. When the "5" button among the number buttons 31 is pressed, the number of copies whose tens digit is 1 and whose units digit is 5 is displayed on the display panel 20, which is shown in FIG. 4B. After step S200 is completed, the flow returns to step S170 again.

In step S150 or S190 described above, if the user did not press a number button 31 (S150 or S190: No), it is determined whether the user has performed a particular operation on the operation panel 30 (S210). In this step, it is determined whether the user has pressed the "*" button 32 or "#" button 33, or whether a series of steps (a setting operation) has been performed from the time when the user has pressed a set button 35 to shift the multifunction machine 1 in a setting mode to the time when the multifunction machine 1 is out of the setting mode.

When the set button 35 has been pressed to shift the multifunction machine 1 in the setting mode, the multifunction machine 1 is ready in a state where settings regarding the copy function (such as quality of image printed by the printer unit 50, and resolution of image read by the scanner unit 60) can be changed using buttons. After the settings are changed, the machine exits from the setting mode.

In step S210, if any particular operation is not performed, the flow returns to step S170 again. On the other hand, if a particular operation is performed by the user (S210: YES), the CPU 41 waits until an input operation is made to the operation panel 30 by the user (S220: NO).

If an input operation is made by the user (S220: YES), it is determined whether the user pressed the start button 36 (S230). If the user pressed the start button 36 (S230: YES), the flow returns to step S140. On the other hand, if the user did not press the start button 36 (S230: NO), it is determined if the user in step S220 pressed the number button 31 (S240). If the user in step S220 did not press the number button 31 (S240: NO), the flow goes to step S210.

On the other hand, if the user in step S220 pressed the number button 31 (S240: YES), the numbers in each digit stored in the RAM 43 representing the value for the number of copies to be made are reset (deleted) and a number corresponding to that of the number button 31 pressed is set as the units digit (S250). In this step, the variable n is reset (all variables n[1] to n[i] are set to "0"), and then the number corresponding to that of the number button 31 pressed is set in the variable n[1], thereby the value for the number of copies to be made is newly set.

Figure 4C:
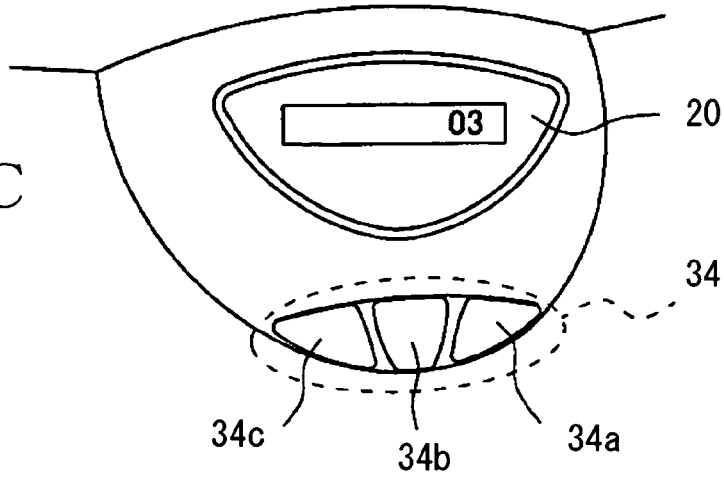

In addition, in step S250, as is the case with steps S160 and S200, what is displayed on the display panel 20 is also changed according to the value set in the variable "n". In step S240, when "3" of the number buttons 31 is pressed, the number of copies whose tens digit is "0" and whose units digit is "3" is displayed on the display panel 20, which is shown in FIG. 4C. Thus, after the particular operation is performed in step S210, the number corresponding to that of the number button 31 pressed is newly set as the value for the number of copies to be made in the RAM 43. After step S250 is completed, the flow returns to step S170 again.

According to the multifunction machine 1 structured thus, when a number button 31 is pressed after a particular operation is performed in step S210 in FIG. 3 and up until the time when an operation to start copying is performed (the start button 36 is pressed), the value for the number of copies to be made (the value set in the variable n) is reset (deleted) in step S250. The number corresponding to that of the number button 31 pressed is also newly set in the RAM 43 as the value for the number of copies to be made (set in the variable n[1]).

For example, in step S210 in FIG. 3, even if the user accidentally presses a number button 31 again after a setting operation (by a set button 35), although the number of copies to be made has already been input, a number corresponding to that of the pressed number button 31 is newly set as the value for the number of copies to be made without fail. After the setting operation described above is performed, even if the number of copies is already input, it is often that a number button 31 is accidentally pressed again or the number of copies to be made is changed according to the settings. Thus, as described above, when a number button 31 is pressed after the setting operation is performed, resetting the value for the number of copies and setting the value for the new number of copies is suitable for preventing problems such as making copies for the number of copies which is different from that the user intends and forcing the user to use the number buttons 31 again for a useless operation.

In step S210 in FIG. 3, even when the user presses the "*" button 32 or the "#" button 33 in a state where the number of copies has already been input, and then accidentally presses a number button 31 again, the number corresponding to that of the number button 31 newly pressed is set as the value for the number of copies to be made without fail.

From these points, accidents can be prevented that are often caused by making a number of copies which is different from what the user intends, and forcing the user to use the number buttons 31 again for a useless operation. Thus, the ease-of-use of the multifunction machine 1 can be improved.

If the user has input the wrong number as the number of copies to be made (pressed an unwilled number button 31), the wrong number can be reset once pressing the "*" button 32 or the "#" button 33 before pressing another number button 31. Especially, as the "*" button 32 and the "#" button 33 are located near the number buttons 31 as apparent from FIG. 1, the number of copies to be made can be quickly reset.

While the invention has been described with reference to specific embodiments, the description of the specific embodiments is illustrative only and is not to be construed as limiting the scope of the invention. Various other modifications and changes may occur to those skilled in the art without departing from the spirit and scope of the invention.

For example, the above embodiment of the invention shows a structure as a copying machine applied to the multifunction machine 1. However, as a copying machine of the invention, any arrangement is possible as long as it is provided with a copy function. For example, the copying machine may be structured as a device other than the multifunction machine 1 such as a multifunction machine having a telephone function.

In the above embodiment, the process shown in FIG. 3 is executed by a computer system comprised of the CPU 41 provided in the multifunction machine 1. However, a part or all of the process may be executed by another computer system connected to the multifunction machine 1 via a wired or wireless signal transmission path.

In the above embodiment, the particular operation in step S210 of FIG. 3 refers to operations with the press of the "*" button 32 or the "#" button 33, and a setting operation. However, as the particular operation, any operation is possible except for an operation to switch the available function (with the press of the scanner function button 34*b* or the facsimile function button 34*c*), and an operation to stop the multifunction machine 1 (with the press of the power button 37).

The operation panel 30 includes number 0 to 9 buttons 31, the "*" button 32, the "#" button 33, the function buttons 34 for switching available functions, the set buttons 35 for setting each function, the start button 36, and the power button 37, which are all provided independently. However, it may be structured as a display device such as a liquid crystal display (LCD) showing virtual buttons thereon with a specification input device such as a touch panel so as to enable various operations.

The invention may be applicable to a computer system where the multifunction machine 1 is connected to a personal computer (PC) via a wired or wireless communication path such that the number of copies to be made can be input to the multifunction machine 1 on the PC side.

Figure 5:
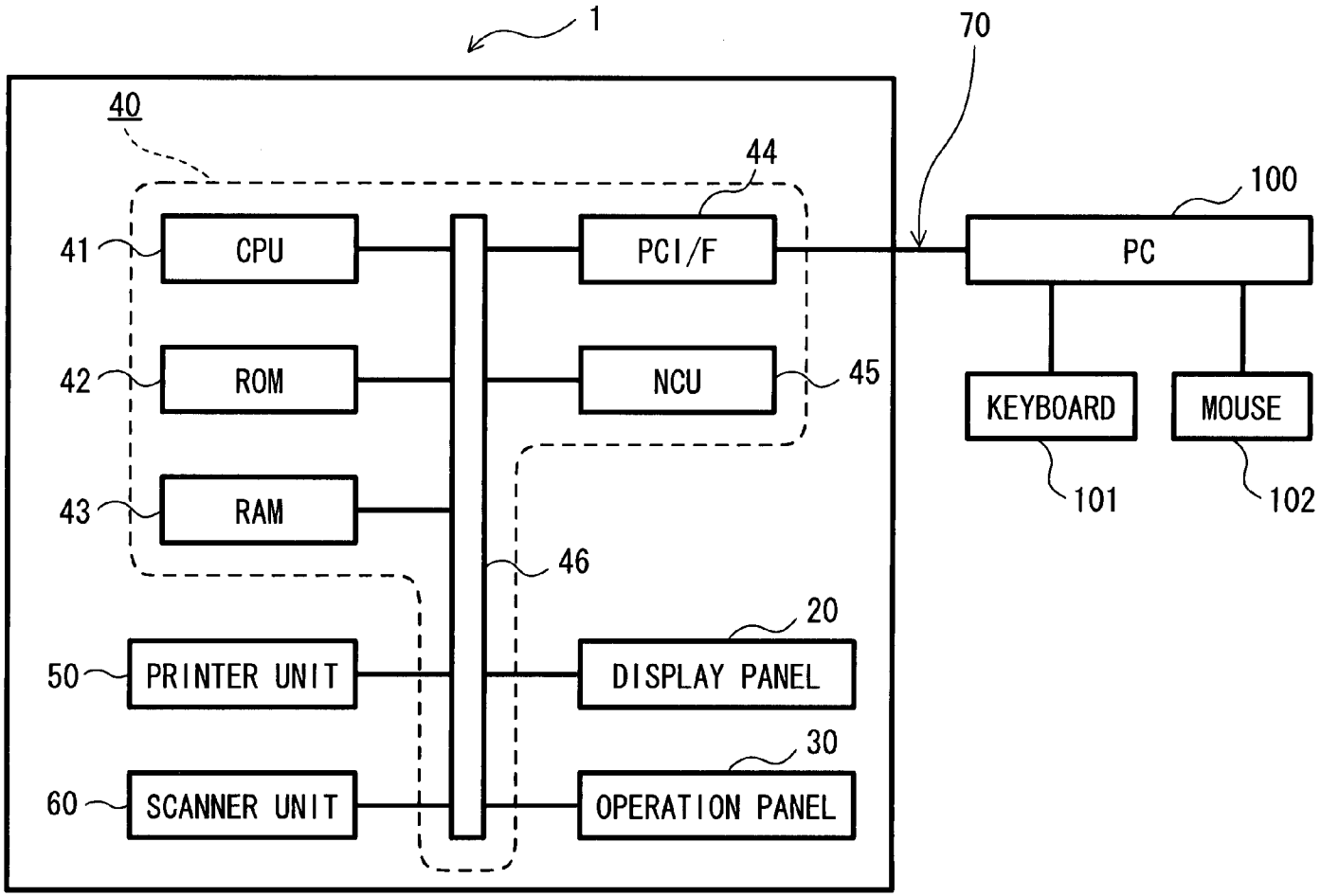
FIG. 5 is a block diagram showing a computer system configuration.

Specifically, as shown in FIG. 5, the computer system is configured wherein the multifunction machine 1 and a PC 100 are connected via a communication cable 70 connected to the PCI/F 44. When the number of copies to be made is input using a keyboard 101 or a mouse 102 connected to the PC 100, it is transmitted to the multifunction machine 1 and stored in the RAM 43 digit by digit as the case with a series of steps from steps S150 to S200 in the above embodiment. When the user presses the start button 36 on the operation panel 30 of the multifunction machine 1 or specifies the copy operation from the PC 100 (by using the keyboard 101 or the mouse 102), the multifunction machine 1 performs the copy function in the printer unit 50 in accordance with the set number of copies to be made.

If the number of copies is input again with the press of a number button 31 or using the keyboard 100 or the mouse 102 connected to the PC 100 after the user changes copy function settings with the press of a set button 35 or using the keyboard 100 or the mouse 102 connected to the PC 100, each digit number stored in the RAM 43 representing the value for the number of copies to be made is reset (deleted) and the number specified with the press of the number button 31 or using the keyboard 102 or the mouse 103 is newly set digit by digit as the case with a series of steps from S210 to S250 in the above embodiment.

In the above computer system, the multifunction machine 1 and the PC 100 are connected via the PCI/F 44, however, they may be connected via a telephone line connected to the NCU 45. Additionally, a terminal connected to the multifunction machine 1 is not limited to a known PC, and may be a cellular phone or a personal digital assistant, PDA.

What is claimed is:

1. A copying machine comprising:

a storing portion that stores a value with n ($n \geqq 2$) digits, the n digits having a range from a first digit to an nth digit on a left side of the first digit, wherein the value indicates a number of copies to be made;

a number input portion capable of inputting numbers;

a copy start input portion capable of inputting an instruction to start copying a document;

a copying portion that copies the document based on the value stored in the storing portion when the instruction to start copying is input; and a controller that:

performs a set process when a new number is input via the number input portion, wherein the value is set such that the new number is newly set as the first digit on a right side of the value and at least one previous number at an ith digit ($1 \leqq i$) of the value is newly set as a (i+1)th digit from the right side of the value and the value that has been set is stored in the storing portion; and performs a resetting process when the new number is input via the number input portion after an operation is performed other than by inputting the new number and up until a time when the instruction to start copying the document is input, wherein the value stored in the storing portion is deleted and the new number input via the number input portion is stored in the storing portion as the first digit of the value.

2. The copying machine according to claim 1, further comprising:

a setting change input portion capable of inputting a change of settings regarding copying the document, wherein the controller performs the resetting process when the new number is input after the change of settings is input via the setting change input portion and up until the time when the instruction to start copying the document is input.

3. The copying machine according to claim 1, further comprising:

at least one of a telephone function and a facsimile function, wherein the number input portion includes a plurality of number buttons for inputting numbers 0 to 9 and forms an operation panel with a "*" button and a "#" button for realizing a part of the telephone function or the facsimile function; and the controller performs the resetting process when the new number is input via the number input portion after the "*" button or the "#" button is pressed on the operation panel and up until the time when the instruction to start copying the document is input.

4. The copying machine according to claim 1, wherein the copying portion is separate from a terminal that includes at least the number input portion with the terminal connected to the copying portion in order to communicate with the copying portion.

5. The copying machine according to claim 1, wherein the first digit on the right side is a units digit and the nth digit on the left side is a tens or higher digit.

6. The copying machine according to claim 1, wherein the value is maintained when the operation is performed.

7. A program for setting a value indicating a number of copies to be made in a computer system, the computer system including a storing portion that stores the value with n ($n \geqq 2$) digits, the n digits having a range from a first digit to an nth digit on a left side of the first digit; a number input portion capable of inputting numbers; a copy start input portion capable of inputting an instruction to start copying a document; and a copying portion that copies the document based on the value stored in the storing portion when the instruction to start copying is input, the program comprising:

a first routine that, when a new number is input via the number input portion, sets the value such that the new number is newly set as the first digit on a right side of the value and at least one previous number at an ith digit ($1 \leqq i$) of the value is newly set as a (i+1)th digit from the right side of the value and stores the value that has been set in the storing portion; and a second routine that, when the new number is input via the number input portion after an operation is performed other than by inputting the new number and up until a time when the instruction to start copying the document is input, deletes the value stored in the storing portion and stores the new number input via the number input portion in the storing portion as the first digit of the value.

8. The program for setting the value indicating the number of copies to be made according to claim 7, further comprising:

a third routine that executes a change of settings regarding copying the document, wherein the second routine is performed when the new number is input after the change of settings is executed via the third routine and up until the time when the instruction to start copying the document is input.

9. The program for setting the value indicating the number of copies to be made according to claim 7, wherein the computer system includes at least one of a telephone function and a facsimile function and the number input portion includes a plurality of number buttons for inputting numbers 0 to 9 and forms an operation panel with a "#" button and a "#" button for realizing a part of the telephone function or the facsimile function, wherein the second routine is executed when the new number is input via the number input portion after the "*" button or the "#" button is pressed on the operation panel subsequent to the execution of the first routine and up until the time when the instruction to start copying the document is input.

10. The program for setting the value indicating the number of copies to be made according to claim 7, wherein the computer system includes a copying machine that includes at least the storing portion and the copying portion and a terminal that includes at least the number input portion with the terminal being separated from the copying machine and connected to the copying machine in order to communicate with the copying machine, wherein the routines are performed in the copying machine.

11. The program for setting the value indicating the number of copies to be made according to claim 7, wherein the first digit on the right side is a units digit and the nth digit on the left side is a tens or higher digit.

12. The program for setting the value indicating the number of copies to be made according to claim 7, wherein the value is maintained when the operation is performed.

13. A method for setting a value indicating a number of copies to be made in a copying machine, the copying machine including a storing portion that stores the value with n ($n \geqq 2$) digits, the n digits having a range from a first digit to an nth digit on a left side of the first digit; a number input portion capable of inputting numbers; a copy start input portion capable of inputting an instruction to start copying a document; and a copying portion that copies the document based on the value stored in the storing portion when the instruction to start copying is input, the method comprising:

setting the value, when a new number is input via the number input portion, such that the new number is newly set as the first digit on a right side of the value and at least one previous number at an ith digit ($1 \leqq i$)

of the value is newly set as a (i+1)th digit from the right side of the value and storing the value that has been set in the storing portion; and deleting the value stored in the storing portion and storing the new number input via the number input portion in the storing portion as the first digit of the value when the new number is input via the number input portion after an operation is performed other than by inputting the new number and up until a time when the instruction to start copying the document is input.

14. The method according to claim 13, further comprising:

executing a change of settings regarding copying the document, wherein the value is deleted when the new number is input after the change of settings is executed and up until the time when the instruction to start copying the document is input.

15. The method according to claim 13, wherein the copying machine includes at least one of a telephone function and a facsimile function and the number input portion includes a plurality of number buttons for inputting numbers 0 to 9 and forms an operation panel with a "*" button and a "#" button for realizing a part of the telephone function or the facsimile function, wherein the value is deleted when the new number is input via the number input portion after the "*" button or the "#" button is pressed on the operation panel subsequent to initially setting the value and up until the time when the instruction to start copying the document is input.

16. The method according to claim 13, wherein the copying portion is separate from a terminal that includes at least the number input portion with the terminal connected to the copying machine in order to communicate with the copying machine.

17. The method according to claim 13, wherein the first digit on the right side is a units digit and the nth digit on the left side is a tens or higher digit.

18. The method according to claim 13, wherein the value is maintained when the operation is performed.

19. A method for setting a value indicating a number of copies to be made in a copying machine, comprising:

setting the value, when a new number is input, such that the new number is newly set as a first digit on a right side of the value and at least one previously input number at an ith digit ($1 \leqq i$) of the value is newly set as a (i+1)th digit from the right side of the value; and deleting the value and storing the new number input as the first digit of the value when the new number is input after an operation is performed other than by inputting the new number and up until a time when the instruction to start copying a document is input.

20. The method according to claim 19, further comprising:

executing a change of settings regarding copying the document, wherein the value is deleted when the new number is input after the change of settings is executed and up until the time when the instruction to start copying the document is input.

21. The method according to claim 19, wherein the value is deleted when the new number is input after a "*" button or a "#" button is pressed subsequent to initially setting the value and up until the time when the instruction to start copying the document is input.

22. The method according to claim 19, wherein the first digit on the right side is a units digit and the nth digit on the left side is a tens or higher digit.

23. The method according to claim 19, wherein the value is deleted subsequent to the setting of the value.

24. The method according to claim 19, wherein the value is maintained when the operation is performed.

* * * * *